US006875462B2

(12) United States Patent
Shiffler, Jr.

(10) Patent No.: US 6,875,462 B2
(45) Date of Patent: Apr. 5, 2005

(54) METHOD OF MAKING A FIELD EMISSION COLD CATHODE

(75) Inventor: Donald A. Shiffler, Jr., Albuquerque, NM (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 10/764,806

(22) Filed: Jan. 26, 2004

(65) Prior Publication Data

US 2004/0202779 A1 Oct. 14, 2004

Related U.S. Application Data

(62) Division of application No. 09/681,703, filed on May 23, 2001, now Pat. No. 6,683,399.

(51) Int. Cl.[7] ..... B05D 5/12

(52) U.S. Cl. ..... 427/58; 427/248.1; 427/427; 427/431; 427/443.2; 427/350; 427/376.1; 427/374.1; 427/374.4

(58) Field of Search ..... 427/58, 77, 248.1, 427/421, 427, 430.1, 431, 443.2, 350, 376.1, 374.1, 374.4, 398.1

(56) References Cited

U.S. PATENT DOCUMENTS

| | | | |
|---|---|---|---|
| 4,143,292 | A | 3/1979 | Hosoki et al. |
| 5,588,893 | A | 12/1996 | Kaftanov et al. |
| 6,057,637 | A | 5/2000 | Zettl et al. |
| 6,091,186 | A | 7/2000 | Cao et al. |
| 6,239,547 | B1 | 5/2001 | Uemura et al. |
| 6,400,091 | B1 | 6/2002 | Deguchi et al. |

OTHER PUBLICATIONS

Garate et al., "Novel Cathode for Field–Emission Applications", Review of Scientific Instruments, vol. 66, No. 3, pp. 2528–2532, American Institute of Physics, New York, Mar. 1995.*

James Benford et al, "Lowered plasma velocity with cesium iodide/carbpm fober cathodes at high electric fields," *Proceedings of the 12th International Conference on High–Power Particle Beams*, vol. 2, pp. 695–698 (1998).

Eusebio Garate et al, "Novel cathode for field–emission applications," *Review of Scientific Instruments*, vol. 66, No. 3, pp. 2528–2532, American Institute of Physics, New York, New York, USA (Mar. 1995).

H. Kosai et al, "Long pulse CsI impregnated field emission cathodes," *Review of Scientific Instruments,* , vol. 61, No. 7, pp. 1880–1882, American Institute of Physics, New York, New York, USA (Jul. 1990).

A. Wadhawan et al, "Effects of Cs deposition on the field–mission properties of single–walled carbon–nanotube bundles," *Applied Physics Letters*, vol. 78, No. 1, pp. 108–110, American Institute of Physics, New York, New York, USA (Jan. 1, 2001).

I. F. Chang et al, "Large–area, Cold, Electron–emitters for Electron Emission," *IBM® Technical Disclosure Bulletin*, vol. 18, No. 9, pp. 3097–3098 (Feb. 1976).

* cited by examiner

*Primary Examiner*—Bret Chen
(74) *Attorney, Agent, or Firm*—James M. Skorich

(57) ABSTRACT

A method for making a field emission cold cathode for use in vacuum tubes. A carbon velvet material is coated with a low work function cesiated salt and bonded to a cathode surface. Alternatively, the carbon velvet material is bonded to the cathode surface before being coated with the cesiated salt. The coating may be applied by spraying the carbon velvet material with a cesiated salt solution, or by dipping the material into a crucible of molten cesiated salt. This abstract is provided to comply with the rules requiring an abstract, and is intended to allow a searcher or other reader to quickly ascertain the subject matter of the technical disclosure. It is submitted with the understanding that it will not be used to interpret or limit the scope or meaning the claims.

8 Claims, 1 Drawing Sheet

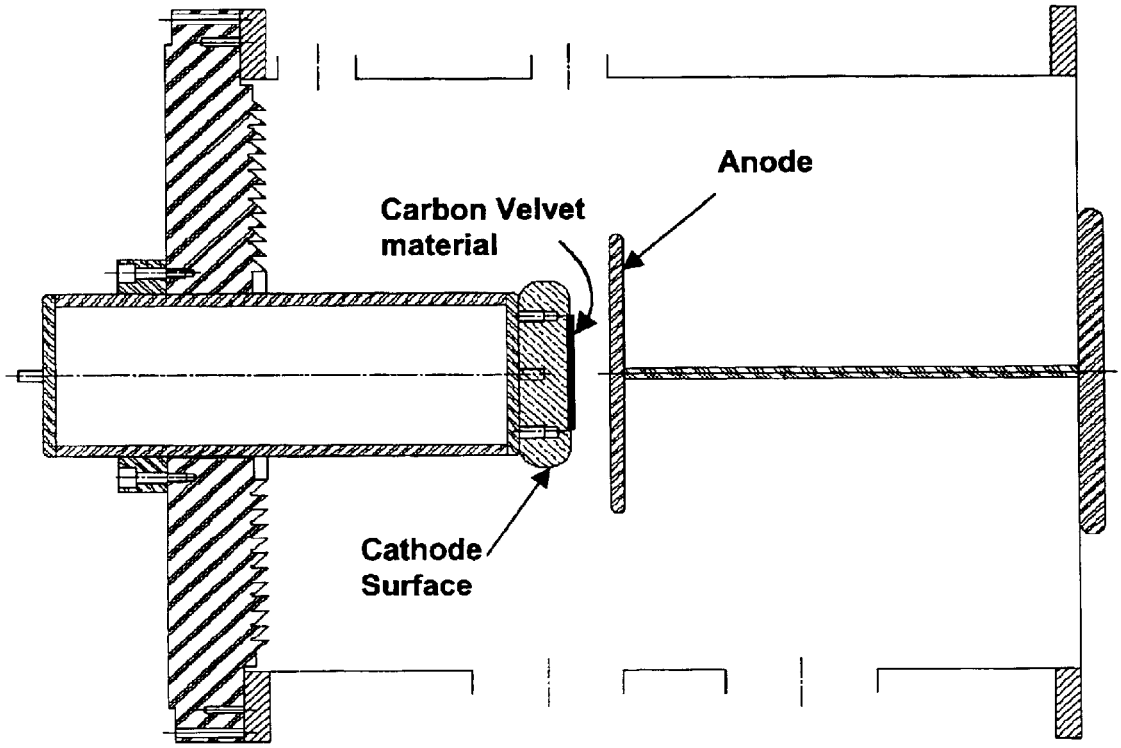
Anode
Carbon Velvet
material
Cathode
Surface

METHOD OF MAKING A FIELD EMISSION COLD CATHODE

CROSS-REFERENCE TO RELATED APPLICATIONS

This application is a division of U.S. application Ser. No. 09/681,703 filed on May 23, 2001, now U.S. Pat. No. 6,683,399 and claims the benefit of the foregoing filing date.

STATEMENT OF GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

FIELD OF THE INVENTION

The invention is in the field of making vacuum tubes, and more particularly relates to a method of making a field emission cold cathode that acts as an electron emitter in a vacuum tube.

BACKGROUND OF THE INVENTION

Cathodes are electron emitters used in a wide variety of vacuum tubes, such as cathode ray tubes used in televisions and various microwave tubes used in radar and communications. All of these cathodes must be kept under a high vacuum and heated to a very high temperature (>900° C.) for proper operation.

High vacuum necessitates the use of special manufacturing techniques, such as having a device that is sealed, as well as extensive baking out procedures. Further, these types of cathodes are susceptible to contamination if the cathode is ever removed from vacuum. The high vacuum thus provides a considerable constraint to tube handling, operation, and storage.

The requirement for high temperature operation poses two severe restrictions. The high temperature requires the use of special materials that can withstand the high temperature operation of the cathode. In addition, the heater reduces the energy efficiency and increases system volume, weight, and complexity.

Accordingly, there is a need for a cathode that can operate at low temperatures and have less stringent vacuum requirements, while delivering the same electron emission characteristics as conventional vacuum tube cathodes.

SUMMARY OF THE INVENTION

In a preferred embodiment, the invention replaces the heated cathode of a conventional vacuum tube with a field emission cold cathode. The cathode is comprised of a "carbon velvet" material coated with a low work function cesiated salt and bonded to a cathode surface. Electrons are emitted when a sufficient voltage is applied to the cathode. It is considerably more energy efficient than a conventional vacuum tube and can operate at a lower vacuum level. The carbon velvet material is a material comprised of high aspect ratio carbon fibers embedded perpendicular to a base material. The carbon velvet material anticipated by the present invention can be bonded to any complex-shaped cathode. This cold cathode can replace the heated cathode of any type of vacuum tube, including, klystrons, traveling wave tubes, magnetrons, magnicons, and klystrode/IOT TV transmitters.

Other aspects and advantages of the present invention will become apparent from the following detailed description, taken in conjunction with the accompanying drawing, illustrating by way of example the principles of the invention.

BRIEF DESCRIPTION OF THE DRAWING

The FIGURE is a schematic of the laboratory setup, including a cross-section of the present invention, used to test the field emission cold cathode characteristics.

DETAILED DESCRIPTION

Conventional vacuum tubes require a high vacuum and a cathode element that must be heated to over 900° C. for proper operation. The field emission cold cathode of the present invention eliminates the heating requirement and operates at a lower vacuum level. The term, "cold cathode," refers to a cathode that operates at or near room temperature, but also refers to cathodes that operate at temperatures below 900° C.

A preferred embodiment of the field emission cold cathode is comprised of a carbon velvet material that is treated with a low work function cesiated salt and bonded to a cathode surface. The carbon velvet material consists of high aspect ratio carbon fibers embedded perpendicular to a base material. A particular material of this type is Vel-Black® optical coating, a proprietary product of Energy Science Laboratories, Inc. It consists of high aspect ratio carbon fibers mounted in an adhesive base. It was developed for its optical characteristics, i.e., as a black applique for ultra-low reflectance and used for stray-light suppression in optical systems.

The material is flexible and can be readily bonded to any shape of cathode. A conductive epoxy can be used to bond the carbon velvet material to a metal cathode or pyrobonding can be used to bond the material to a carbon substrate.

The low work function cesiated salt can be deposited on the carbon velvet material in several different methods. Two of the preferred methods of making the present invention employ a solution of highly purified cesiated salt and de-ionized (DI) water as the medium for cesiated salt deposition. Cesiated salt is first mixed with de-ionized water. The carbon velvet material can then be sprayed with the cesiated salt solution using an atomizer. Grade five dry nitrogen is used to provide the back pressure for the atomizer. From two to four coats are applied. The cathode is then placed in a vacuum oven, evacuated to less than 1 torr., baked at a sufficient temperature and duration to evaporate the de-ionized water (over 100 degrees centigrade for about an hour or more), and then vented to atmospheric pressure using grade five dry nitrogen. A single cycle of three coatings will improve cathode performance and reduce out-gassing. However, further cycles of three coatings can be repeated, with improvements on each cycle. A number of low work function cesiated salts can be used, including cesium iodide (CsI), cesium tellurate ($CsTeO_4$), and cesium bromide (CsBr).

The cathode can also be dipped tip first into this cesiated salt solution and the entire assembly, cathode and solution, baked to about 100 degrees centigrade or greater at atmospheric pressure such that the solution crystallizes around the tips of the cathode. Once the solution has crystallized, the cathode is placed in a vacuum oven and baked to remove any remaining water. The system is then vented to the atmosphere using dry nitrogen.

In addition, the cesiated salt can be deposited by dipping the carbon cathode into a crucible of molten cesiated salt. The cathode is placed so that the carbon tips of the carbon velvet material extend into the molten bath. The molten cesiated salt is then allowed to cool with the cesiated salt crystallizing at the cathode tips. Cesiated salt can also be deposited by chemical vapor deposition such that the cesiated salt crystals form near the tips. Each of these processes is more expensive and time consuming than using the DI water solution of cesiated salt, but each results in a more uniform coating of the cesiated salt. On the other hand, it is not necessary to bake out the cathode to remove excess water vapor with these methods.

The FIGURE is a schematic of the laboratory setup, including a cross section of the present invention, used to test the field emission cold cathode characteristics. It consists of a vacuum vessel with a high voltage bushing, cathode mount, cathode and anode. The anode-cathode gap can be changed by moving the shaft upon which the anode is mounted. A sufficient negative voltage is applied to the cathode. An electric field as low as 0.9 kV/cm has been demonstrated to be sufficient to initiate electron flow. This is far less than the typical electric fields used in conventional vacuum tubes. Electrons are emitted from the cathode surface and accelerated through the anode-cathode gap and the electrons then impact the anode. The high voltage source may be a pulsed or continuous. The cathode can be employed in any general geometry from circular to spherical, cylindrical, or planar, or in any other complex shape. The anode-cathode gap can represent any interaction region or other region in which the electrons are used. The anode region can be any region or structure in which electrons are collected.

The turn-on field (the electric field level at which the electrons start to flow) of the cathode can be tailored in several ways. The length and density of the carbon fibers can be varied. A longer, narrower tip and a lower tuft density permit greater field enhancements at the fiber tips and hence a lower effective turn-on field. The turn-on field can also be reduced by changing the amount of cesiated salt in solution and by varying the number of coats applied to the surface. In some microwave tubes it is desirable to not have electrons flow until the voltage reaches its full value. This can be accomplished by varying the tuft density and/or the amount of cesiated salt applied, either by the number of coats or by the saturation level of cesiated salt in solution with DI water.

It is to be understood that the preceding is merely a detailed description of several embodiments of this invention and that numerous changes to the disclosed embodiments can be made in accordance with the disclosure herein without departing from the spirit or scope of the invention. The preceding description, therefore, is not meant to limit the scope of the invention. Rather, the scope of the invention is to be determined only by the appended claims and their equivalents.

What is claimed is:

1. A method for coating a carbon velvet material attached to a cathode to make a field emission cold cathode, comprising:

forming a solution of a low work function cesiated salt and de-ionized water;

spraying the carbon velvet material with the cesiated salt solution to form a coated carbon velvet material;

baking the coated carbon velvet material at a temperature of at least 100° C. for approximately an hour in a vacuum oven evacuated to less than 1 torr.; and venting the vacuum oven to an atmospheric pressure using dry nitrogen.

2. A coating method as recited in claim 1, wherein the spraying step includes pressurizing a spraying means with dry nitrogen.

3. A coating method as recited in claim 1, wherein the cesiated salt is selected from a group consisting of cesium tellurate and cesium bromide.

4. A coating method as recited in claim 1, wherein the steps of forming, spraying, baking, and venting are repeated until a film of cesiated salt having a desired thickness is formed on the carbon velvet material.

5. A method of making a field emission cold cathode, comprising:

depositing a vaporized cesiated salt solution onto fibers of a carbon velvet material;

forming cesiated salt crystals on the fibers; and bonding the carbon velvet material to a cathode.

6. A method of making a field emission cold cathode comprising:

attaching a carbon velvet material having fibers to a cathode;

dipping the fibers in a molten cesiated salt solution; and cooling the solution.

7. A method of making a field emission cold cathode comprising:

attaching a carbon velvet material having fibers to a cathode;

dipping the fibers in a molten cesiated salt solution; and removing the fibers from the solution.

8. A method as recited in claim 7 wherein the steps of dipping and removing are repeated until a film of cesiated salt having a desired thickness is formed on a plurality of the fibers.

* * * * *